United States Patent [19]

Levy

[11] Patent Number: 4,581,615

[45] Date of Patent: Apr. 8, 1986

[54] DOUBLE REFLECTOR ANTENNA WITH INTEGRAL RADOME REFLECTOR SUPPORT

[76] Inventor: Stanley P. Levy, 1037 E. Lemon Ave., Monrovia, Calif. 91016

[21] Appl. No.: 464,956

[22] Filed: Feb. 8, 1983

[51] Int. Cl.[4] ..... H01Q 19/19; H01Q 19/06

[52] U.S. Cl. ..... 343/755; 343/781 P; 343/872; 343/910

[58] Field of Search ..... 343/755, 872, 781 CA, 343/912, 781 P, 910

[56] References Cited

U.S. PATENT DOCUMENTS

| | | | |
|---|---|---|---|
| 3,296,685 | 1/1967 | Suliteanu | 343/912 |
| 3,430,244 | 2/1969 | Bartlett et al. | 343/755 |
| 3,430,245 | 2/1969 | Wolcott | 343/755 |

FOREIGN PATENT DOCUMENTS

| | | | |
|---|---|---|---|
| 0084420 | 7/1983 | European Pat. Off. | 343/781 CA |
| 1004622 | 11/1951 | France | 343/872 |
| 170502 | 3/1960 | Sweden | 343/781 CA |

*Primary Examiner*—Eli Lieberman

*Attorney, Agent, or Firm*—Paul D. Supnik; Sidney Levy

[57] ABSTRACT

A two reflector microwave antenna has a concave focusing main dish having an integral peripheral flange. An integral radome shell also having a peripheral flange is disposed in confronting relationship to the main dish flange. Mounted over both flanges is a clamping ring to keep the main dish and radome shell in a stress condition of fixed edge shells. A secondary reflector is provided on a central portion of the radome. The concave focusing main dish in one example, defines a paraboloid of revolution. Specific shapes of the main dish and the radome shell are selected to appropriately focus the microwave radiation. A radome portion of a variable thickness of dielectric material of the integral radome shell modify the path of microwave energy compensating for diffraction of induced edge spillover. The stress condition of the shells as maintained by the clamp about the flanges provides a structually rigid antenna substantially void of structural elements.

9 Claims, 12 Drawing Figures

DOUBLE REFLECTOR ANTENNA WITH INTEGRAL RADOME REFLECTOR SUPPORT

FIELD OF THE INVENTION

This invention relates to reflector antennas used for the transmission and reception of microwave energy and more particularly to antennas of the variety that use a plurality of reflectors to direct the energy to and from the source and receiver.

BACKGROUND OF THE INVENTION

Reflector microwave antenna systems are widely used in radar and in microwave communications to concentrate the energy emitted from a transmitter or incoming to a receiver. A major field of use is in satellite communications systems both to transmit signals to the satellite and from the satellite and for earth stations which receive the signals from the satellite broadcasts.

Two mirror systems are widely known and are interesting because they move the focus of the energy from a point in front of the primary reflector, usually a paraboloid, to a point at, or near, the center of the primary reflector. The form of the systems used parallel the telescope systems referred to as Gregorian and Cassegrain where the main difference is related to the form of the curve on the secondary reflector.

The advantages that accrue to the use of these systems is that they eliminate the need for a support for a preamplifier unit at the primary focus and lead in transmission lines and place the incoming signal at a convenient position to directly attach the receiver amplifiers and other apparatus near the rear of the main reflector. In addition the secondary reflectors can be of such a design as to minimize the effects of diffraction induced signal "spill". The resulting effect is to make the antenna relatively more efficient than the simple paraboloid reflector and much more convenient to use and service.

There are two main drawbacks to the current designs. One is that the support used for the secondary reflector must be in the path of the microwave energy and may either distort the signal or attenuate it significantly leading to loss of signal quality. The other substantial disadvantage to the prior art devices is that they are quite massive units for the diameter of the primary reflector and the additional structure used to support the secondary reflector adds still further to the weight. The mass of the system restricts the locations where the unit can be installed. It also adds to the complexity and drive requirements and the mountings needed for supporting and aiming the unit.

One of the major uses for these antennas is in earth stations for receiving direct broadcast signals from satellites. For this application it would be desirable to have lightweight units capable of being mounted on rooftops in order to be used in small buildings as well as larger ones. None of the prior art antennas seem capable of being reduced sufficiently in weight to accomplish this without substantial performance penalties.

OBJECTS OF THE INVENTION

Accordingly it is an object of this invention to provide a lightweight double reflector microwave antenna unit of unique design which is capable of efficient reception of microwave signals.

It is another object of this invention to provide a double reflector microwave antenna with an integral radome structure to minimize exposure of the reflector surfaces and microwave components to inclement weather.

It is a further object of this invention to provide a double reflector microwave antenna in which the integral radome structure is used to support the secondary reflector.

It is yet another object of this invention to provide an antenna which structurally comprises stiff shell elements which will maintain shape integrity under load at substantially thinner walls than antennas made with conventional structures.

It is a further object of this invention to provide an antenna in which "spill" correction can be provided by using the radome as an optical element in the system to correct the signal pattern by refraction and diffraction of the waves passing therethrough.

It is yet another objective of the invention to provide means for attaching steering units to the antenna in a simplified and low cost form.

SUMMARY OF THE INVENTION

The present invention is an improvement in that it consists of two attached shells to make a radome covered system. The integral radome provides the support for the secondary reflector in the appropriate spatial relationship to the primary reflector so that the focal point for the incoming energy is located at a point at, or near, the center of the surface of the primary reflector.

The shape of the radome can be flat, conical, or curved as necessary for any particular design requirement dictates. It is preferred for structural reasons that the radome be either a conical or curved unit since this type of shell is inherently stiff and resistant to distortion by applied loads even when the wall thickness of the shells is small. Since the radome shell which supports the secondary reflector also must pass the microwave energy, it should be as thin as possible and be made from a suitable dielectric material in order to minimize the attenuation of the microwave energy passing therethrough.

The general arrangement of the reflectors can be either a Gregorian or Cassagrain system with secondary reflectors that are flat, elliptical, hyperboloid, or other suitable surface that will converge the incoming energy to the focus located near the center surface section of the main reflector which is usually a paraboloid of revolution.

The introduction of the radome structure into the path enables its use as a corrective element in the antenna system. It is akin to the Matsuko corrector plate in another telescope system where the errors in the convergence can be corrected by suitably altering the thickness of the corrector plate to refract the waves passing through in a small degree to compensate for the system aberrations. The use of the radome element as a dielelectric lens will enable the correction of the wave fronts to provide a sharper focus.

In addition to use as a dielectric lens element, the radome element can be used to support a diffraction element which can also be used as a wave front corrector. This is usually applied in the form of circular conductor elements with appropriate spacing to deflect the wave fronts by interference effects between the waves.

The availability of these options in the design of the antenna will permit the construction of antennas in which spillover effects are minimized and will make the antenna quite efficient as compared with prior art constructions of the dual reflector antenna units. This is a consequence of the additional refinement which can be made in the focussing of the microwave energy so that it all enters the receiving horn or is accepted by a dipole element.

As will be demonstrated in the discussion of the details of the invention, it will also be possible to provide windows through portions of the reflectors to which sensitive detectors can be attached to aid in aiming and tracking the transmitting source. Since even the so-called geo-stabilized satellite orbits wander to some extent it is frequently necessary to adjust the antenna for maximum signal by centering the boresight on the emitting source. A typical detector could be a bolometer or a dipole tuned to the frequency of the microwave radiation. These would be connected to suitable detector equipment to determine relative signal strength for aiming the antenna.

BRIEF DESCRIPTION OF THE DRAWINGS

The present invention will be described in detail with reference to the appended drawings in which.

DETAILED DESCRIPTION OF THE PREFERRED EMBODIMENTS

Figure 1:
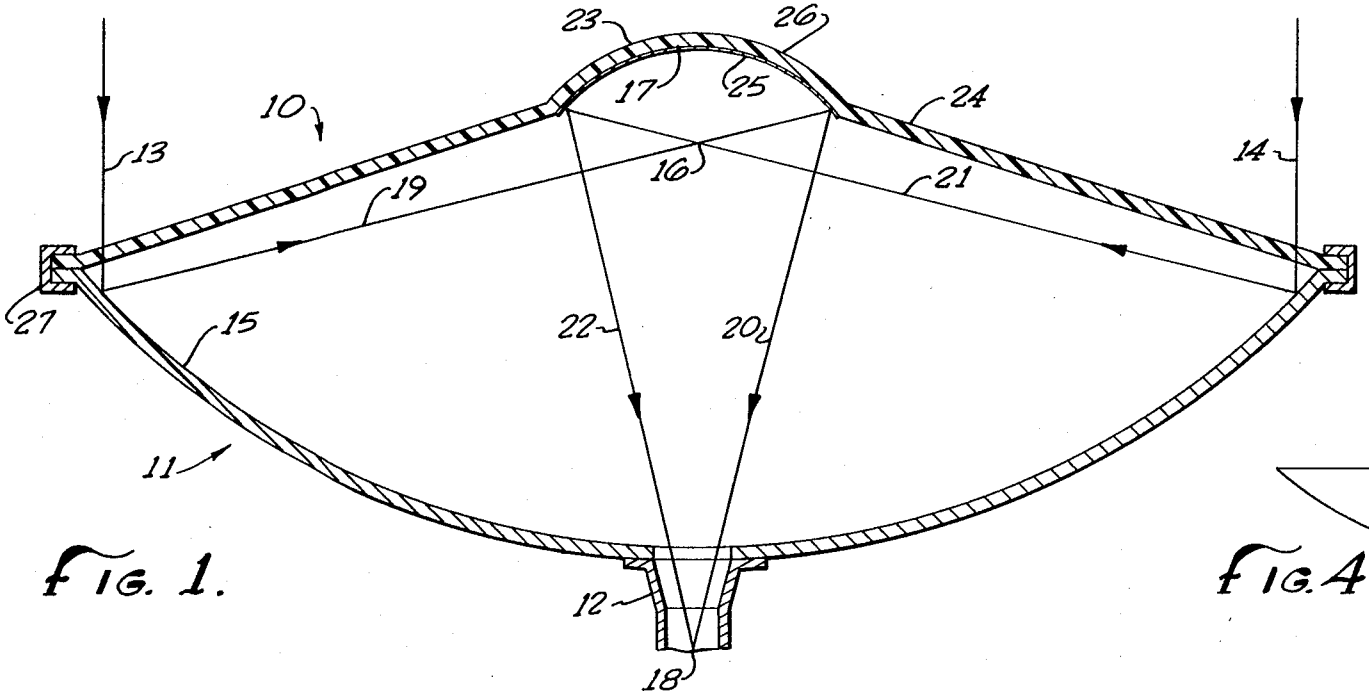
FIG. 1 is a vertical section through one form of the structure of the instant invention and is one of the preferred embodiments of the invention.

Referring to FIG. 1 which shows a vertical section through one form of the preferred embodiment which comprises a front shell 10 which is the combined radome and secondary reflector support and a rear shell 11 which is the primary reflector and the support for the waveguide section 12 that conveys the microwave energy into the receiver apparatus. The rays shown at 13 and 14 are reflected from the primary reflector surface 15, which is a paraboloid, to the focus at point 16 and beyond to the surface of the secondary reflector 17, which is a prolate ellipsoid, and thence to the secondary focus at 18 which is in the waveguide section 12. The path followed by ray 13 is along 19 and 20 to the focus 18 and the path followed by ray 14 is along 21 and 22 to the focus at 18.

The primary reflector 11 can either be made from a metallic conductor or from a non-conductor which has the reflective surface 15 rendered conductive by one of the means well known in the arts. The radome portion of the antenna 10 must be made of a dielectric material such as a plastic with appropriate electrical properties as will hereinafter be described. A portion of the radome portion of the antenna comprises the secondary reflector with the ellipsoid shape 23, the inner surface of which must be a conductor in order to reflect the microwave energy. This portion 23 of the antenna can be a metallic unit fastened onto the radome portion 10 of the antenna. Alternatively it can comprise the dielectric of the radome portion which has been rendered conductive on the surface 17 by means well known in the arts.

Figure 2:
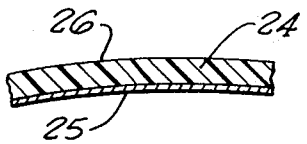
FIG. 2 is an enlarged detail of the wall of the secondary reflector in the embodiment of FIG. 1.

FIG. 2 shows a detail of the wall 26 which comprises a dielectric 24 to which is attached a metallic conductor surface layer 25 by the means well known in the arts. This is the preferred construction of the reflective layer on the secondary reflector since it does not require attaching the reflector 23 to the radome front shell section 10.

Figure 3:
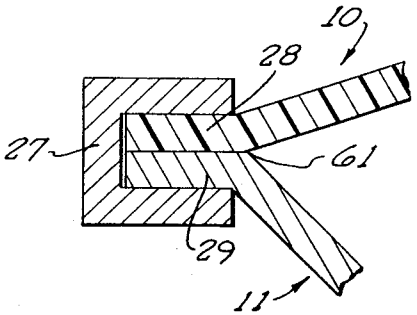
FIG. 3 shows an enlarged portion of the point of joinder between the radome and the main reflector showing the details thereof.

In FIG. 3 is shown the construction of a typical embodiment of the joint 61 between the front shell 10 and the rear shell 11. The movement of the flange 28 of the front shell 10 and the flange 28 of the rear shell 11 is restrained by means of a clamping ring 27 shown in section in FIG. 3. The movement is restrained both perpendicular to the joint 26 and tangentially to the two shells. This restraint prevents distortion of the front shell 10 and the rear shell 11 by the application of loads to the surfaces of the front shell 11 and the rear shell 11 from wind loads, snow and ice or other dynamic or static forces to which the antenna may be subjected to in use. Yet, as is apparent, the radome front shell 10 and the rear shell 11 are substantially void of structural elements and rigidity is achieved through registration and alignment of the rear shell 11 with the front shell 10.

It is well known that shells of the type used to construct the antenna elements undergo far less distortion under load when constrained in the manner shown in FIG. 3 as compared to the degree of distortion when the edges are unconstrained as they are in the typical reflector dish. In the reference Formulas for Stress and Strain by Raymond J. Roark 4th Edition (McGraw Hill) on pages 303–305 are given the deflection formulas for shells of this type and it can be seen by inspection that the deflections for fixed edge shells are substantially less than those for shells with free edges. In a practical example it is necessary for the average thickness of a typical parabolid dish six feet in diameter with unconstrained edges made of polyester glass materials with an elastic modulus of 1,000,000 psi to be between 0.200" and 0.300". By contrast the same size paraboloid constrained in the manner shown in FIG. 3 can be made from a thermoplastic such as acrylonitrile-butadiene-styrene polymer with a modulus of elasticity of 400,000 with a thickness of 0.100". If the ABS material were foamed to a density of 0.4 and had a corresponding modulus of 150,000 psi the thickness would be between 0.200" and 0.300". Using the polyester fiberglass material with a modulus of 1,000,000 psi the wall thickness would be 0.050" or less and for aluminum with a modulus of 10,000,000 psi the wall would be well under 0.030". For the higher stiffness materials the constraint on the wall thickness would be related to buckling resistance rather than deflection as a limiting factor.

There are other limitations with respect to the average wall thickness of the shells based on methods for fabrication of the parts and of handling the parts prior to assembly. It is clear, however, that the method of constraining the two shells will lead to much thinner walls and lower weight for the antenna without any sacrifice in maintaining the shapes under load.

The constraining ring 27 should be made of a high modulus material to insure that it not distort under the loads transferred from the inner and outer shells 10 and 11. A metal element or one made from a carbon or glass fiber reinforced plastic which has high elastic moduli—10,000,000 psi or greater—would be suitable in the appropriate cross section.

While the clamping ring 27 is a preferred embodiment, other methods of constraining the edges of the shells 10 and 11 such as clamps and other fasteners which fulfill the criteria of fixing the edges in relationship to each other may be used where the design dictates. In addition the edges can be joined by any of the well known methods of structural adhesive bonding which are sufficiently strong to constrain the edges of the shells 10 and 11 from moving relative to each other.

Figure 4A:
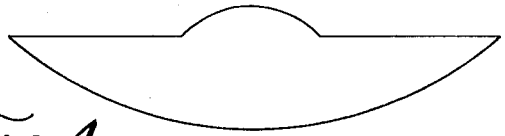
FIGS. 4*a*, 4*b* and 4*c* show several structural configurations of the two units which make up the construction of the invention in schematic view.
Figure 4B:
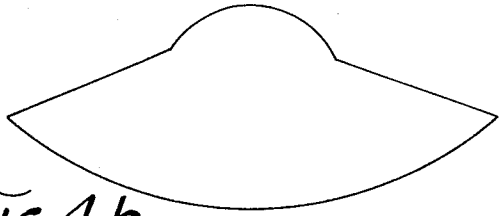
Figure 4C:
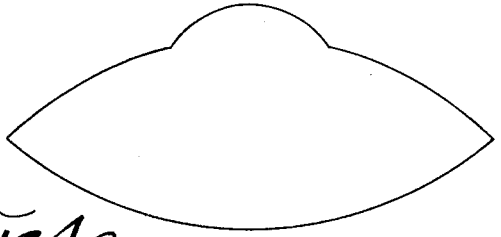

A number of variations of shape are possible with the shells 10 and 11 which make up the antenna of the instant invention. In FIG. 4 are shown three variations of basic shape for the front shell 10 which can be used in specific designs that require them. FIG. 4(*a*) shows the upper shell 10 as flat with only a curved secondary reflector. This configuration may be more subject to distortion than the conical section shown in 4(*b*) and the curved section shown in 4(*c*) and, while useable, is less preferred than 4(*b*) and 4(*c*).

Figure 6A:
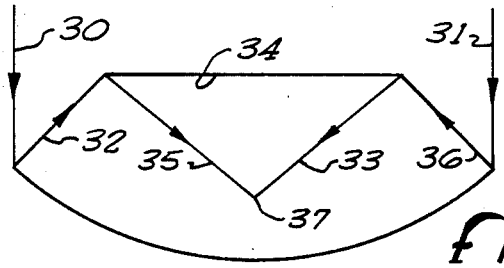
FIGS. 6*a*, 6*b* and 6*c* show schematically the several constructions of secondary reflectors that are used with the invention and how the microwave energy is directed to a focal point at or near the center of the surface of the primary reflector
Figure 6B:
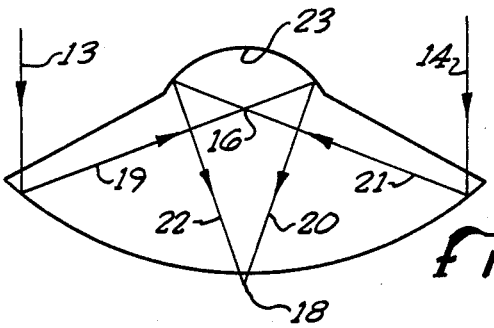
Figure 6C:
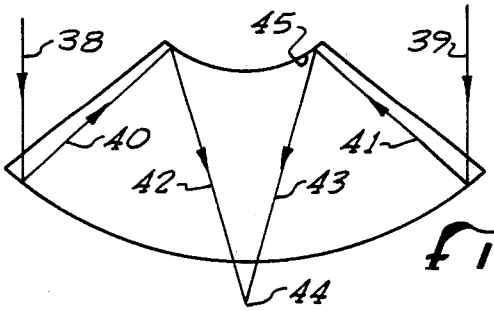

The shapes of the secondary reflector may also be different as is shown in FIG. 6. FIG. 6(*b*) shows the ray paths 13,19,20 and 14,21,22 which correspond to those of FIG. 1 when the secondary reflector is a prolate ellipsoid. The first focus which is common to the main paraboloid reflector and the ellipsoid is at 16 and the final focal point at the surface of the primary 18.

FIG. 6(*a*) shows the use of a flat secondary reflector 34 which generates ray paths 30,32,35 and 31,36,33 to bring the energy to a focus at 37 which is near the surface of the primary reflector. FIG. 6(*c*) illustrates the use of a hyperbolid of revolution 45 as the secondary reflector and the paths of the incoming rays are 38,40,42 and 39,41,43 which brings the energy to a focus at 44 behind the main reflector.

Each of the primary secondary combinations is useful with the instant invention and the selection of the specific optical system that will be employed will depend again on the requirements for a specific antenna.

Prior experience has shown that microwave energy is not exactly reflected and focussed as simply as shown in real antenna systems. One of the limitations is that the reflectors are limited in size for practical reasons so that they are generally only twenty to thirty wavelengths in diameter especially in the popular 7.5 cm band. The waves are diffracted at the edges of the reflectors with a spillover of energy which is not properly directed. A number of methods have been devised to avoid this problem and to permit uniform illumination of the reflectors an example of which is the use of a dual curve hyperboloid reflector as is described in U.S. Pat. No. 3,983,560 to MacDougall. The instant invention provides means for doing the edge corrections to minimize the "spillover" which are conveniently done because of the unique construction of the antenna.

Figure 5:
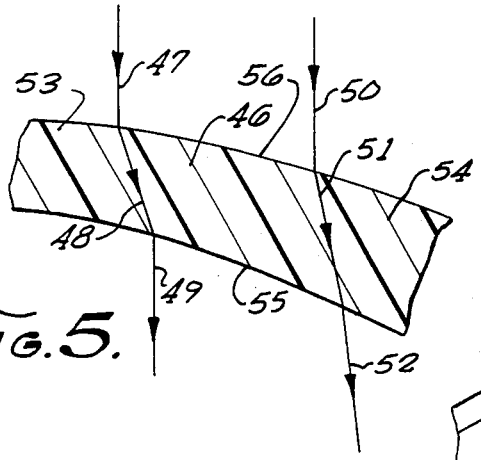
FIG. 5 is a section of a portion of the radome portion of the antenna structure in which the wall is of variable thickness so that it acts as a dielectric lens.

One of the methods of changing the paths of the incoming energy is illustrated in FIG. 5. A section of the radome shell 10 is shown 46 which has a portion 53 where the inner surface 55 is parallel to the outer surface 56 and another adjacent portion 54 where the inner surface 55 is at an angle to the outer surface 56. The ray 47,48,49 goes through the element 46 at 53 and is displaced laterally but continues in the same direction. At location 54 however as a result of the nonparallel surface condition the ray 50,51,52 exits from the surface 55 at an angle to its original path.

The radome shell 10 is operating as a dielectric lens which can modify the paths of the incoming microwave energy. It is in fact used as a Matsuko type corrector element. By both calculation and experiment the shell 10 can be designed so that the surfaces 55 and 56 will form a corrector element that will reduce the change in directions caused by the edge diffraction effects and more accurately bring the microwave energy to the desired focus.

Figure 7:
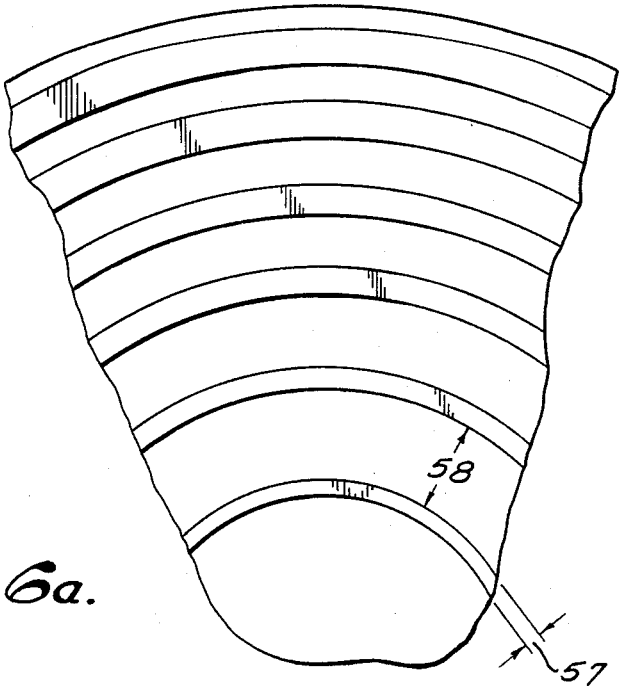
FIG. 7 shows in plan view a diagram of a wave plate with conductors attached thereto which can modify the wavefront of the microwave energy by diffraction.

Another method for correcting for the edge diffraction "spillover" can be incorporated into the antenna of the instant invention. A diffraction or zone plate can be introduced into the path of the microwave energy as it enters the antenna. Such a plate is constructed by using conductive bands of the correct width and spacing which may be applied to the surface of the radome shell 11. Such a pattern is shown schematically in FIG. 7.

It is well known in the optical and microwave arts that such zone plates can be used to modify, by diffraction of the incoming energy, the paths of the rays going through the system. The spacings 58 and the band widths 59 are of the order of the wavelength of the incident energy in order to produce the diffraction effects. The changes in path direction can be calculated using well known principles and verified by experiment. The wave plate can be produced which will correct for the edge diffraction effects produced at the reflectors to direct the microwave energy to a more acurate focus.

In specific instances one or the other of the correction systems, both, or neither can be incorporated into the antenna. The choice will be determined by the desired operating characteristics of the antenna. The availability of the means to do the correction in the instant invention without the use of complex additional structures enables the design of more efficient antenna systems using the principles of the instant invention.

Figure 8:
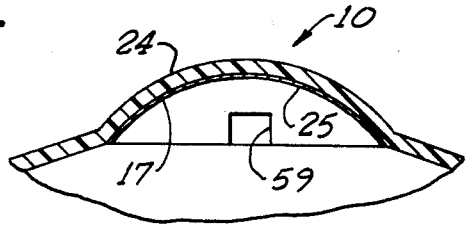
FIG. 8 shows a vertical section of one form of secondary reflector with provisions for windows through which some of the microwave energy can be directed to sensitive detectors for steering and aiming the antenna.

Another feature which can be added to the antenna of the instant invention is illustrated in FIG. 8. Through the conductive surface 25 of the radome shell 10 at the secondary reflector 17 windows 59 are made which permit the microwave energy to pass through the dielectric 24. By adding appropriate sensors for the microwave energy to the surfaces at points it will be possible to sense the magnitude of the energy and this can be used to aim and steer the antenna unit so that it may be accurately aimed at the source of the microwaves for maximum signal reception.

Typical materials of construction for the antenna of the instant invention can be either metals or plastics for the structure of the two reflector elements. In the case of the plastics supporting structure the reflecting surfaces will have a layer of highly electrical conducting material applied by means well known in the arts. This material could be any metal either as a continuous layer or in a binder where the amount of conductive filler is sufficiently high to render the surface highly conductive at microwave frequencies.

Some typical structural metals are aluminum and steel. Typical plastics structural materials are polyester glass laminates, ABS plastic, acrylic plastic, polyolefin plastics, and a wide variety of other types which are widely available. The plastics materials may contain reinforcing agents for additional stiffness and may be cellular-foam-materials for additional stiffness for a given weight.

The radome shell 10 must be made of a dielectric material in those parts which pass the microwave energy i.e. all of the areas except the area of the secondary reflector. The dielectric materials should be those which have low dielectric loss factors at the frequencies of the microwave energy used for the signal to be received or transmitted. Some typical materials which may be used are glass reinforced low loss polyester resins, low loss fluorocarbon plastics such as TFE, FEP, and PFA resins, acrylic resins, polyolefin resins, some styrene resins, and a number of other materials which have been widely used to make antenna elements such as windows and radomes for use with microwave energy. The materials selected will also have to meet the structural rigidity and weathering requirements of the antenna.

By way of example the preferred embodiment shown in FIG. 1 if it were intended for use in the 7.5 cm band, would have a diameter of about six feet. The depth of the parabola would be around fourteen inches and the radome shell would likewise have a height of approximately fourteen inches. The reflector shell 11 could be made from an ABS plastic approximately 0.100" thick with a copper conductive surface applied. The radome shell 10 could be made from acrylic resin plastic which is known to be a good radome material at 4 gigaherz and this would also be adequately stiff at a thickness of 0.100". These would be joined with a metal band 27 to impart the condition of total constraint at the joint 26 so that there would be a minimum distortion resulting from any applied loads. The antenna would be held in position by support means which can be attached either to the metal band 27 or by means attached to the feed horn 12.

There are many variations and combinations of elements which are possible that will enable the persons skilled in the arts to construct antennas according to the teachings of the instant invention which are within the scope of the invention. The description of the specific preferred embodiments in the specification are for the purposes of illustration of the principles of the invention are not intended to limit the scope of the invention.

The scope of the invention is only limited as described in the appended claims.

What I claim is:

1. A two reflector microwave antenna comprising:

a concave focusing main dish with an integral peripheral flange;

an integral radome shell having a peripheral flange in confronting relation with said main dish flange;

a clamping ring mounted over both said flanges to maintain said dish and radome shell in a stress condition of fixed edged shells; and a secondary reflector provided on a central portion of the radome.

2. A two reflector antenna as described in claim 1 wherein said concave focusing main dish has an inner reflector surface defining a paraboloid of revolution.

3. A two reflector microwave antenna as described in claim 1 wherein the secondary reflector is selected from the group comprising a flat plate, a prolate ellipsoid and a hyperboloid of revolution.

4. A two reflector antenna as described in claim 1 wherein said integral radome shell has a structural shape selected from the group consisting of a flat circular plate, a conical shape, and a shape produced by the revolution of a curve of suitable form that will provide said integral radome shell with good resistance to deformation from applied stresses when said integral radome shell is constrained at its periphery by said clamping ring.

5. A two reflector microwave antenna as described in claim 1 wherein said integral radome shell having a radome portion of a variable thickness of dielectric material, said variable thickness of dielectric material causing said radome portion of said integral radome shell to act as a dielectric lens, said dielectric lens modifying the path of said microwave energy through said antenna to compensate for the effect of diffraction induced edge spillover from said primary and secondary reflectors, and to constitute a corrector element in said microwave energy path to enhance the accuracy of focus of said antenna, and direct more said incoming microwave energy to said microwave receptor apparatus.

6. A two reflector microwave antenna as described in claim 1 wherein said integral radome shell having a radome portion, the radome portion having placed thereon a series of conductive bands of appropriate width and spacing to act as a diffraction plate, said diffraction plate being capable of redirecting the paths of said microwave energy through said antenna by diffraction effects, said redirected microwave energy paths compensating for edge spillover caused by edge diffraction on said primary and secondary reflectors to minimize energy loss and direct more of said incoming microwave energy to said microwave receptor apparatus.

7. A two reflector microwave antenna as set forth in claim 1 wherein said radome outwardly of said secondary reflector is provided with wave shaping means for focusing microwave energy.

8. The invention as set forth in claim 7 and in which the main dish and the integral radome shell are substantially void of structural elements.

9. The invention as set forth in claim 7 and in which the main dish and the integral radome shell having curved portions whereby substantial rigidity is achieved through the substantial registration and alignment of the integral radome with the main dish.

* * * * *